US005471789A

United States Patent [19]

Faircloth

[11] Patent Number: 5,471,789

[45] Date of Patent: Dec. 5, 1995

[54] ARCHED SHUTTER ASSEMBLY

[76] Inventor: Robert A. Faircloth, Rte. 2, Box 484A, Roseboro, N.C. 28382

[21] Appl. No.: 397,854

[22] Filed: Mar. 2, 1995

[51] Int. Cl.[6] ..... E06B 7/08

[52] U.S. Cl. ..... 49/74.1; 49/77.1; 160/84.07

[58] Field of Search ..... 49/74.1, 77.1, 49/87.1; 160/134, 84.07; 454/221, 227, 278

[56] References Cited

U.S. PATENT DOCUMENTS

| | | | |
|---|---|---|---|
| 705,202 | 7/1902 | Buckman | 49/82.1 X |
| 3,075,257 | 1/1963 | Rosen | 49/74.1 X |
| 4,537,040 | 8/1985 | Ibrahim | 160/84.07 X |
| 4,860,492 | 8/1989 | Roy | 49/82.1 |
| 4,936,048 | 6/1990 | Ruggles | 49/74.1 |
| 5,339,591 | 8/1994 | Underdahl | 49/74.1 X |

FOREIGN PATENT DOCUMENTS

| | | | |
|---|---|---|---|
| 542495 | 8/1922 | France | 49/77.1 |
| 222069 | 6/1910 | Germany | 160/134 |

*Primary Examiner*—Brian K. Green
*Assistant Examiner*—Jerry Redman
*Attorney, Agent, or Firm*—Rhodes, Coats & Bennett

[57] ABSTRACT

An arched shutter assembly is provided having generally V-shaped or tapered louvers operated by a uniformly arched operating arm all mounted within an arched peripheral frame. Each louver rotates on an axis that is aligned with a center reference point at the juncture of a central hub and radial frame members. The arched shutter assembly can be shaped to fit a variety of arched or circular windows and is commonly used to provide an operable shutter for an arched window above a rectangular door or window.

12 Claims, 4 Drawing Sheets

ARCHED SHUTTER ASSEMBLY

FIELD OF INVENTION

The present invention pertains to interior window shutters and particular pertains to an arched window shutter assembly including a circularly operable louver section mounted within an arched frame.

BACKGROUND OF THE INVENTION

Interior window shutters are a popular and practical alternative to blinds, drapes or curtains used to regulate the entry of light into a home or other building. Interior window shutters, usually constructed of wood, provide a more durable and classically attractive alternative to other window dressings. Typically, interior window shutters are either square or rectangularly shaped and include a multitude of horizontally extending slats or louvers operated by a vertically extending rod or arm.

Up until now, it has been difficult if not impossible to provide operating window shutters that cover an arched or circular window. This has been due to the difficulty in constructing a workable, movable interior window shutter for shapes of windows other than rectangular. Oftentimes, fixed, immovable shutters, which cannot be adjusted to regulate light, or simply another form of window dressing must be used over arched or circular windows.

The window screen of Simon, U.S. Pat. No. 1,447,189, shows a semicircular shutter panel assembly operated in conventional fashion by ropes and cables to open and close an arched window. However, Simon's semicircular design window screen does not have the versatility and adaptability of the interior arched shutter assembly of the present invention. In particular, Applicant's arched shutter assembly can be manufactured with an elliptical or other irregular shape; however, Simon's design is capable of operation only with a semicircular shape because Simon's operating mechanism is attached to the slats at their outermost ends. Since the operating mechanism must lie in a uniform arc, Simon's design is limited to circular and semicircular shapes.

SUMMARY AND OBJECTS OF THE INVENTION

The present invention provides an arched shutter assembly, which may be constructed to fit a variety of curved or circularly shaped windows, that opens and closes by a unique uniformly arched operating arm. A single operating quadrant of the arched shutter assembly has a peripheral frame that includes two radial members and an arched rim. An interior hub block is seated at the juncture of the two radial members and includes an outer arched edge. Rotatably mounted between the outer arched edge of the interior hub block and an inner arched edge of the arched rim are a plurality of louvers. Each louver is mounted to the hub block via a hub pivot bushing and to the rim via a rim pivot bushing. Each louver rotates on its rotating axis, which extends through the hub pivot bushing and the rim pivot bushing and which is aligned along a radial axis extending outwardly from a center reference point at the juncture of the two radial frame members and the interior hub block. The louvers are opened and closed by a uniformly arched operating arm that is equidistant along its length from the center reference point. The operating arm is attached to each louver by an eyelet in the operating arm and by a staple running through the eyelet and into the edge of the louver.

The method of manufacturing the arched shutter assembly involves assembling a first sub-assembly including the louvers and the operating arm. Eyelets are first embedded in one side of the operating arm at regular intervals. Then each eyelet is stapled to an edge of each louver. The second sub-assembly is assembled by seating the interior hub block in the crux or juncture of two radial members. Next, hub pivot bushings on the smaller interior ends of the louvers are fitted into hub apertures on the outer arched edge of the interior hub block. After the louvers and operating arm sub-assembly is fitted into the interior hub block, the arched rim is attached to the ends of the radial members and the larger exterior ends of the louvers. Rim pivot bushings on the exterior ends of the louvers are seated into rim apertures on the interior arched edge of the arched rim.

One of the objects of the present invention is to provide an operable interior window shutter that is shaped to fit an arched or circular window.

It is another object of the present invention to provide an arched shutter assembly that aesthetically matches standard rectangular shutters and, when positioned above a rectangular shutter, preserves the continuity of the overall window.

It is still another object of the present invention to provide a circularly operable interior window shutter that can be built to fit a variety of curved or circular window shapes.

It is yet another object of the present invention to provide a simple arched shutter assembly that is easily operated by a single uniformly arched operating arm.

It is a further object of the present invention to provide a method of manufacturing an arched shutter assembly.

Other objects and advantages of the present invention will become apparent and obvious from a study of the following description and the accompanying drawings which are merely illustrative of such invention.

DETAILED DESCRIPTION OF THE INVENTION

Figure 1:
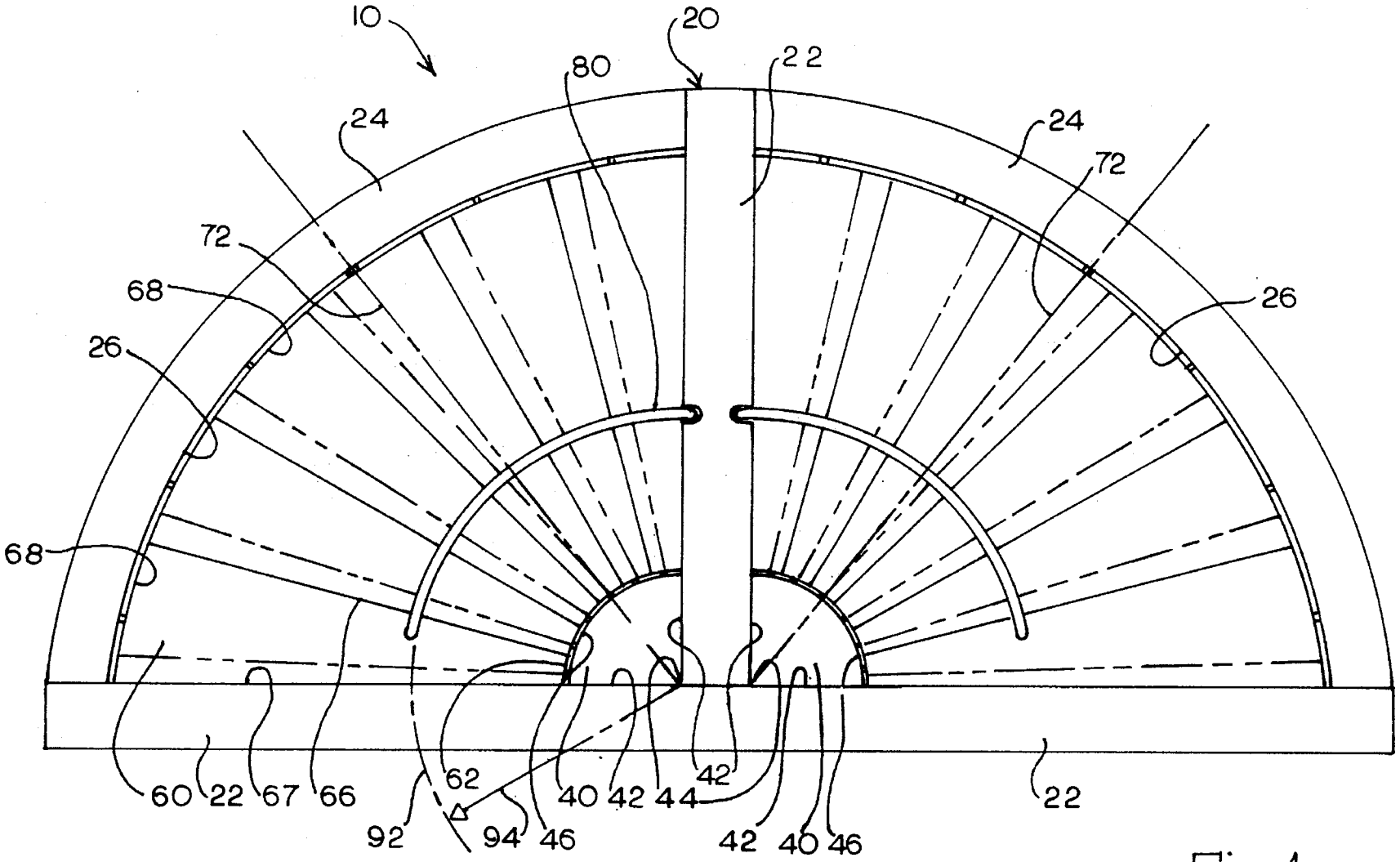
FIG. 1 is an elevational view of the arched shutter assembly of the invention with the louvers closed.

With further reference to the drawings, the arched shutter assembly of the present invention is shown therein and generally indicated by the numeral 10. In focusing on the shutter assembly 10, the components of only one operating quadrant (half of the depicted embodiment) will be described for convenience and clarity. It should be understood, however, that any number of operating quadrants or operating sections could be included in a complete shutter assembly 10. Also, in the embodiment depicted here, the shutter assembly 10 is designed to cover a semi-circularly arched window or door. However, the shutter assembly 10 of the invention could also be round to cover a circular window or elliptical, ovoid, or otherwise irregularly shaped to cover a correspondingly shaped window. While typically constructed with wood, the shutter assembly 10 could also be made of plastic or metal depending on the appearance or cost desired. The simple, versatile design of the present invention lends itself to easy assembly and operation.

As illustrated in the drawings, the preferred embodiment of the invention comprises an arched peripheral frame, generally indicated by the numeral 20; an interior hub block, generally indicated by the numeral 40; a plurality of rotatable louvers, each indicated by the numeral 60; and a uniformly arched operating arm, generally indicated by the numeral 80. The peripheral frame 20 includes two radial members 22 per quadrant and an arched rim 24. The interior hub block 40 is seated at the juncture of two of the radial members 22 and includes two radial sides 42 that converge at a center reference point 44. As should be understood, it is not necessary that the hub block 40 be absolutely uniform. The hub block 40 shown here includes an outer arched edge 46 that, in this embodiment, is uniformly curved or arched. However, the outer arched edge 46 of the hub block 40 could also be non-uniformly arched, just as the peripheral frame 20 is shown here uniformly arched but could also be elliptical, ovoid, or otherwise non-uniformly arched.

Figure 1A:
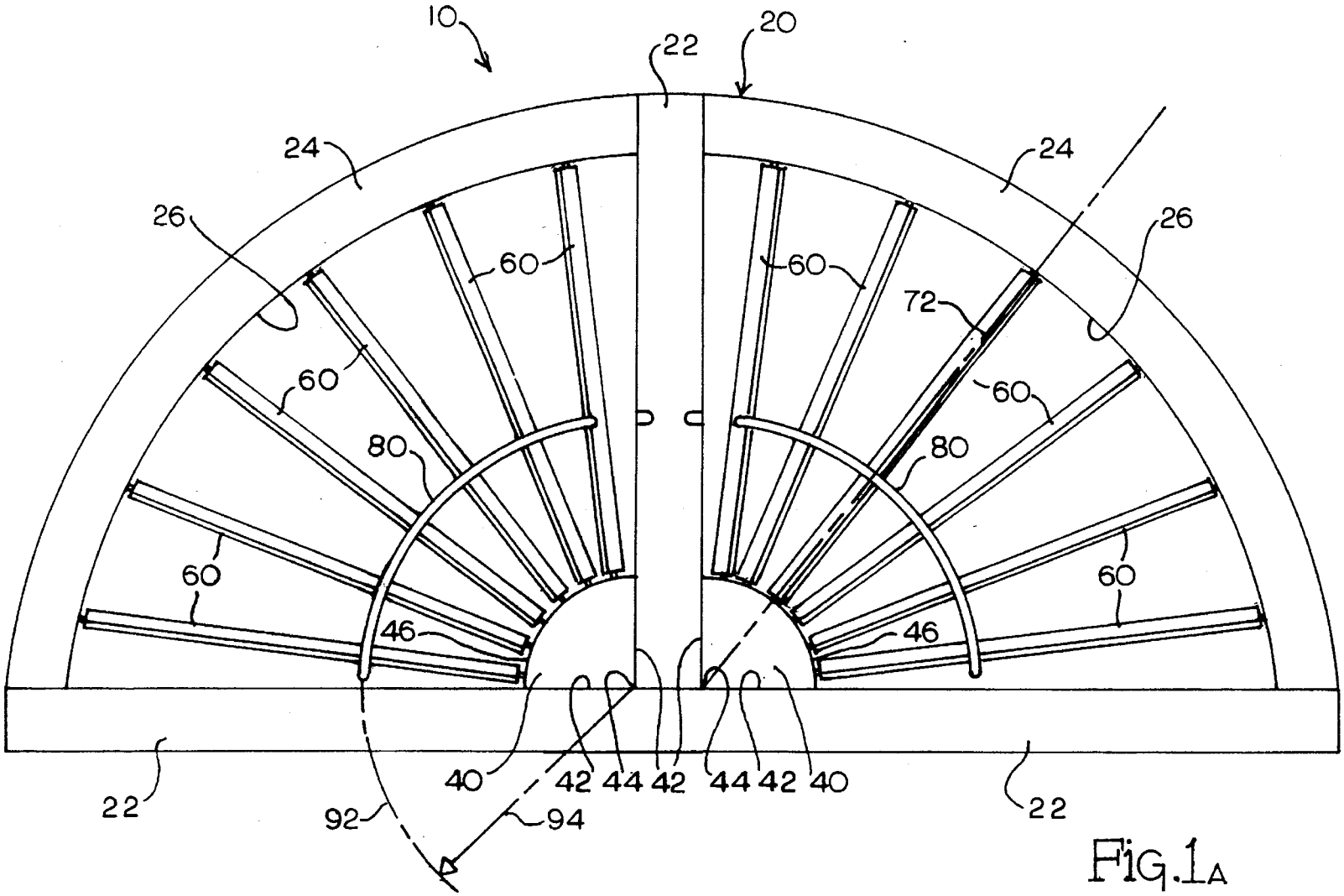
FIG. 1*a* shows the arched shutter assembly of FIG. 1 with the louvers open.

The rotatable louvers 60 are radially mounted between the interior hub block 40 and the arched rim 24. FIG. 1 depicts the louvers 60 in a closed position and FIG. 1*a* depicts the louvers 60 in an open position. Each louver 60 is of a general V-shape (having opposed sides tapering inwardly toward the hub block 40) with a concave interior end 62 that generally conforms to the outer arched edge 46 of the interior hub block 40. Each louver 60 has two radial edges 66, 67 that diverge toward a wider exterior end 68 that, in this embodiment, has a slightly convex curve to generally conform to the interior arched edge 26 of the arched rim 24. As should be understood, the purpose of the shapes of the interior and exterior ends 62, 68 of the louvers 60 is to conform as closely as possible to the shapes of the interior hub block 40 and the arched rim 24, respectively, to shut out light. For example, in another embodiment (not shown), the louvers could have flat ends that conform to a polygonal shaped hub block and an interior edge with a series of angled flat surfaces.

Figure 4:
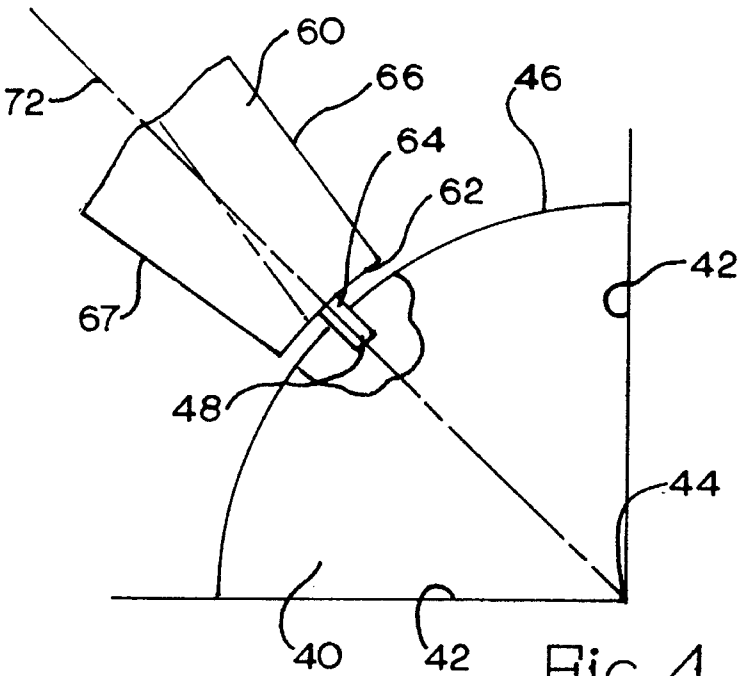
FIG. 4 is a fragmentary side elevational view of a louver and the hub block and particularly illustrates how the louver is rotatably connected within the hub block.
Figure 3:
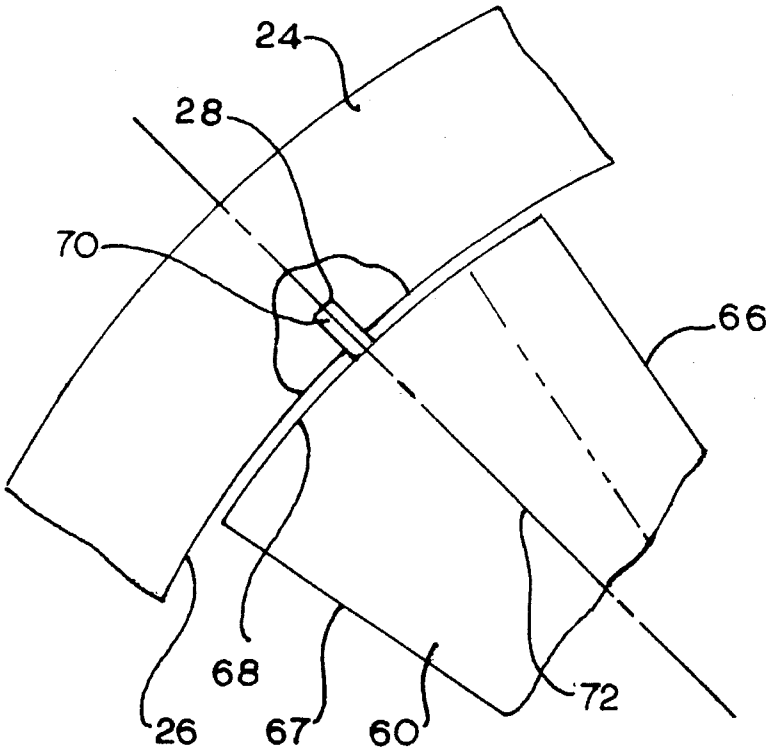
FIG. 3 is a fragmentary side elevational view of a louver and outer rim and particularly illustrates how the louver is rotatably mounted within the rim.

FIGS. 3 and 4 show, respectively, the attachment means by which each louver 60 is attached to the arched rim 24 and the interior hub block 40. FIG. 3 shows an enlarged view of the attachment point of the louver 60 with the inner arched edge 26 of the arched rim 24. A rim pivot bushing 70 is attached along the major rotating axis 72 of the louver 60 on the exterior end 68 of the louver 60. The rim pivot bushing 70 is rotatably seated within a rim aperture 28 in the inner arched edge 26 of the arched rim 24. The rim apertures 28 in the arched rim 24 are evenly spaced so that the louvers 60 are likewise evenly spaced within the peripheral frame 20. FIG. 4 shows an enlarged view of the interior end 62 of the louver 60 with its hub pivot bushing 64 rotatably seated within a hub aperture 48 in the interior hub block 40. A plurality of hub apertures 48, one for each louver 60, are evenly spaced along the outer arched edge 46 of the hub block 40.

Each louver 60 has a major rotating axis 72 running through the center of the louver 60, equidistant along its length from each radial edge 66, 67. The hub pivot bushing 64 and the rim pivot bushing 70 are mounted on each end 62, 68, respectively, of the louver 60 in line with the rotating axis 72. As shown in FIG. 4, each hub aperture 48 is aligned coaxially with the rotating axis 72 of the corresponding louver 60. When extended inwardly, the rotating axes 72 of all the louvers 60 intersect at the center reference point 44. Additionally, each rim aperture 28 is aligned coaxially with a respective rotating axis 72. As should be understood, each quadrant of the shutter assembly 10 is generally planar; therefore, the rotating axes 72 are all coplanar. While only one rotating axis 72 and one louver 60 is depicted in FIG. 4, it should be understood that each louver 60 has its own rotating axis 72 that intersects the center reference point 44. The rotating axes 72 are evenly spaced as are the louvers 60 themselves.

Figure 2:
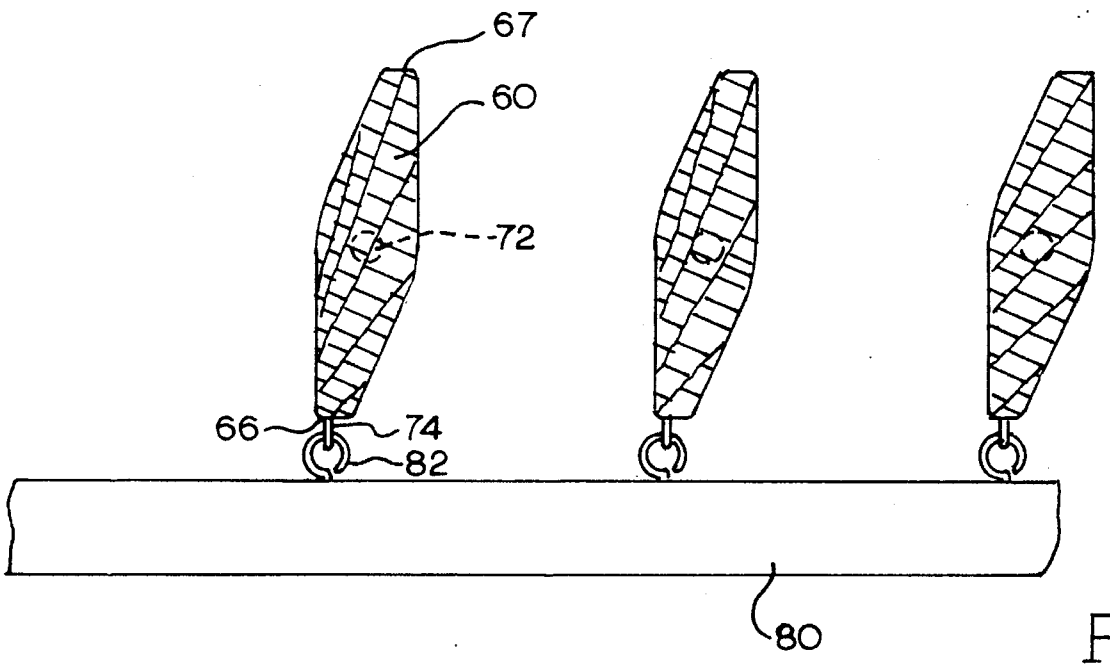
FIG. 2 is a fragmentary cross-sectional view of three individual louvers in an open position and attached to the operating arm.
Figure 2A:
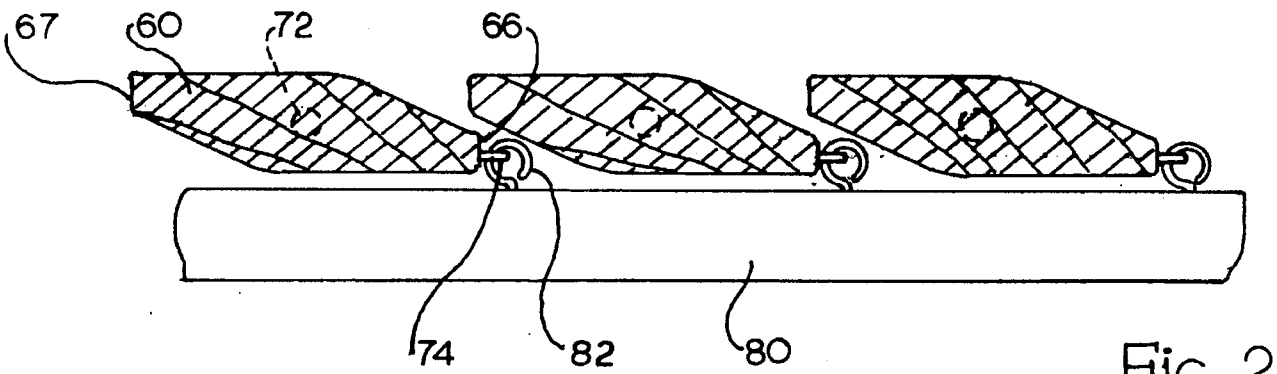
FIG. 2*a* shows the louvers and operating arm of FIG. 2 wherein the louvers are in a closed position.

A uniformly (circularly) arched operating arm 80 is attached to each louver 60 by a fastener such as an eyelet 82 and a connector such as a staple 74. As is depicted in FIGS. 2 and 2*a*, the eyelets 82 are evenly spaced along one side of the operating arm 80. Each louver 60 is attached to an eyelet 82 by a staple 74 that is embedded in a radial edge 66 of the louver 60 and runs through the eyelet 82. There is enough play or looseness between the eyelet 82 and the staple 74 to cause a loss of motion upon movement of the operating arm 80. This is so the operating arm 80 will not grab or stick during opening and closing of the louvers 60. FIG. 2 shows the louvers 60 in an open position to allow light to enter a room; whereas, FIG. 2*a* shows the same louvers 60 in a closed position to seal out light. Also depicted in FIGS. 2 and 2*a* is the location of the rotating axis 72 relative to the individual louver 60. In this embodiment, the rotating axis 72 is centrally located within the louver 60.

Referring now back to FIGS. 1 and 1*a*, the uniformly arched operating arm 80 is equidistant along its length from the center reference point 44. Stated another way, the operating arm 80 is disposed in a uniform arc 92, the focal point of which coincides with the center reference point 44. While the peripheral frame 20 and the interior hub block 40 do not necessarily have to be circularly arched, the operating arm 80 occupies an arc 92 of a circle, the center of which is the center reference point 44. It should be understood that the staples 74 in the radial edges 66 of the louvers 60 are also equidistant from the center reference point 44. In this embodiment, all of the louvers 60 are of the same width; therefore, all the staples 74 are at equal distances from the rotating axes 72. While the operating arm 80 is disposed a constant radius 94 from the center reference point 44, there is no criticality to the lengths of the portions of the louvers 60 outward of the operating arm 80. If, for example, a frame 20 was constructed in an elliptical shape to fit an elliptically arched window, some louvers 60 would be longer than others, and the arched rim 24 would not be uniformly arched as it is depicted in this embodiment.

When installed above a standard rectangular window having a rectangular shutter (not shown), the arched window shutter assembly 10 of the invention continues the design of a typical rectangular shutter having a central, vertical, straight operating arm. The operating arm 80 of the arched shutter assembly 10 is shown near the center of the louvers 60, not only so that the louvers 60 may extend to any length outwardly of the operating arm 80, as explained above, but also so that the operating arm 80 will be generally aligned with an operating arm in the center of a rectangular shutter.

The method of manufacturing the arched shutter assembly 10 of the invention involves first assembling the louvers 60 and operating arm 80 sub-assembly and then mounting it in the peripheral frame 80. The first step is to embed a series of evenly spaced eyelets 82 on one side of the arched operating arm 80. Each eyelet 82 is then stapled to a radial edge 66 of an individual louver 60 such that each staple 74 is spaced an equal distance 94 from a point where lines extending inwardly from the rotating axes 72 of all the louvers 60 intersect. This point corresponds to the center reference point 44 at the joinder of the interior hub block 40 and the radial members 22 of the frame. A rim pivot bushing 70 is attached to the exterior end 68 of each louver 60, aligned along the rotating axis 72 of the louver 60. A hub pivot bushing 64 is attached to the interior end 62 of the louver 60, also aligned along the rotating axis 72 of the louver 60.

Next, the frame sub-assembly is constructed. As shown in this embodiment, radial members 22 are set at 90° angles. However, any number of radial members 22 could be used and could be set at angles other than 90°. Set between each pair of radial members 22 is an interior hub block 40 having two radial sides 42 that converge at the center reference point 44. The center reference point 44 can also be defined as being the vertex of the angle formed by the inner sides of the radial members 22. The hub block 40 has an outer arched edge 46 that has an evenly spaced series of hub apertures 48, each of which is radially aligned with a rotating axis 72.

The two sub-assemblies are then fitted together by first seating the hub pivot bushings 64 on each louver 60 within the hub apertures 48 on the outer arched edge 46 of the hub block 40. Next, the arched rim 24 is attached to the radial frame members 22 and each louver 60 is attached to the arched rim 24 by seating the rim pivot bushings 70 on the exterior ends 68 of the louvers 60 into evenly spaced rim apertures 28 on the inner arched edge 26 of the rim 24. Each rim aperture 28 is aligned with a rotating axis 72 that, when extended inwardly, intersects the center reference point 44 and is aligned with a corresponding hub aperture 48. As stated previously, the operating arm 80 is positioned to occupy a uniform, circular arc, the focal point of which is the center reference point 44, such that the operating arm 80 is a constant radius 94 along its length from the center reference point 44.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An arched shutter assembly, comprising:

a) a peripheral frame, including
   1) a plurality of radial members, and
   2) an arched rim having an inner arched edge that includes a series of evenly spaced rim apertures;

b) an interior hub block seated at a juncture of two of the radial members, including an outer arched edge having a series of evenly spaced hub apertures;

c) a plurality of louvers mounted within the frame, each louver including
   1) an interior end having a hub pivot bushing seated in one of the hub apertures,
   2) two diverging radial edges,
   3) an exterior end having a rim pivot bushing seated in a corresponding rim aperture,
   4) a rotating axis extending through the rim pivot bushing, through the louver, and through the hub pivot bushing, the rotating axes of all the louvers intersecting a center reference point, and
   5) a connector embedded in one of the radial edges a selected distance from the exterior end, the connectors in adjacent louvers each being spaced an equal distance from the center reference point; and d) a uniformly arched operating arm having a plurality of evenly spaced eyelets connected to the connectors in the louvers such that the operating arm occupies a uniform arc, equidistant along its length from the center reference point.

2. The arched shutter assembly of claim 1 wherein the rotating axis extends through the center of the louver, equidistant from each radial edge.

3. The arched shutter assembly of claim 2 wherein all of the louvers are the same width so that the connectors in adjacent louvers are each spaced an equal distance from the rotating axes.

4. The arched shutter assembly of claim 1 wherein each connector comprises a staple that hooks through a corresponding eyelet loosely so that there is lost motion upon movement of the operating arm.

5. An arched shutter assembly, comprising:

a) a peripheral frame including a plurality of radial members and an arched rim;

b) an interior hub block seated at a juncture of two radial members;

c) a plurality of louvers, each louver pivotally mounted to the frame between the interior hub block and the arched rim, each louver having a rotating axis that intersects a center reference point when extended inwardly; and d) a uniformly arched operating arm operably attached to each louver, the operating arm disposed in a uniform arc of a generally constant radius from the center reference point, the radius being shorter than the radial members.

6. The arched shutter assembly of claim 5 wherein the hub block has an outer arched edge and the arched rim has an inner arched edge.

7. The arched shutter assembly of claim 6 wherein each louver is rotatably attached at an interior end to the outer arched edge of the hub block and at an exterior end to the inner arched edge of the arched rim.

8. The arched shutter assembly of claim 7 wherein each louver includes two diverging radial edges and wherein the rotating axis extends through the center of the louver from the interior end to the exterior end, generally equidistant from each radial edge.

9. The arched shutter assembly of claim 8 wherein the operating arm includes a series of evenly spaced eyelets connected to a series of staples embedded in the radial edges of the louvers.

10. The arched shutter assembly of claim 9 wherein each staple is loosely held by a corresponding eyelet to allow motion between the staple and eyelet upon movement of the operating arm.

11. The arched shutter assembly of claim 7 wherein each louver further comprises a hub pivot bushing attached to the interior end and a rim pivot bushing attached to the exterior end, the hub pivot bushing rotatably mounted to the outer arched edge of the hub block and the rim pivot bushing rotatably mounted to the inner arched edge of the arched rim.

12. The arched shutter assembly of claim 9 wherein the outer arched edge of the hub block includes a series of hub apertures that receive the hub pivot bushing of each louver, and wherein the inner arched edge of the arched rim includes a series of rim apertures that receive the rim pivot bushing of each louver.

* * * * *